United States Patent [19]

Araki et al.

[11] Patent Number: 4,599,856

[45] Date of Patent: Jul. 15, 1986

[54] HYDRAULIC APPARATUS USED FOR OPERATING VEHICLES

[75] Inventors: Hideo Araki, Tokyo; Chiharu Matsunaga, Ayase, both of Japan

[73] Assignee: Toshiba Kikai Kabushiki Kaisha, Tokyo, Japan

[21] Appl. No.: 396,148

[22] Filed: Jul. 7, 1982

[30] Foreign Application Priority Data

Jul. 8, 1981 [JP] Japan ..... 56-106717

[51] Int. Cl.[4] ..... F15B 13/06; F15B 13/09

[52] U.S. Cl. ..... 60/421; 60/422; 60/430; 91/514; 91/516; 91/532

[58] Field of Search ..... 60/430, 421, 422; 91/28, 29, 516, 514, 532

[56] References Cited

U.S. PATENT DOCUMENTS 3,279,558 10/1966 Allen et al. ..... 60/430
3,355,994 12/1967 Malott ..... 60/430
4,306,488 12/1981 Uehara ..... 91/516

FOREIGN PATENT DOCUMENTS 470663 7/1975 U.S.S.R. ..... 91/28

*Primary Examiner*—Edward K. Look
*Assistant Examiner*—John M. Husar
*Attorney, Agent, or Firm*—Koda and Androlia

[57] ABSTRACT

A hydraulic apparatus for a vehicle having a propulsion engine comprises a control valve, a flow dividing valve, pumps driven by the engine for delivering fluid to the valves, and steering and implement circuit operatively connected to the control and flow dividing valves. The control valve includes plunger provided with orifices having variable degrees of openings and a spool connected to the plunger and the flow dividing valve includes a spool. With the hydraulic apparatus this constructed, fluid having an amount necessary for operating the steering circuit is always fed thereinto by operatively connecting the spools of the control and flow dividing valves and sharing the fluid into the steering and implement circuit by controlling the fluid dividing valve in accordance with pressure difference between the upstream and downstream portions of the orifices in the control valve.

1 Claim, 2 Drawing Figures

HYDRAULIC APPARATUS USED FOR OPERATING VEHICLES

BACKGROUND OF THE INVENTION

This invention relates to hydraulic apparatus for supplying fluid to implement and steering circuits used for vehicles such as articulated shovel loaders.

Generally, a hydraulic apparatus of an articulated shovel loader comprises three pumps, including one change-over pump, driven by a propulsion engine of a vehicle and a flow dividing valve delivering fluid, usually oil, from the change-over pump to steering and implement circuits in accordance with revolutions of the engine. With the hydraulic apparatus thus constructed, when the engine is driven at a low or neutral speed, the change-over pump is always communicated with the steering circuit through the flow dividing valve, so that even in a time of low speed steering operation which can be performed with a small amount of oil, since the oil from the change-over pump is added to the oil from a pump for operating the steering circuit, a considerably large amount of oil which is utilized for a high speed steering operation flows into the steering circuit. In addition, the flow of such large amount of oil increases pressures of the steering and change-over pumps.

Thus, a potential energy of a large amount of excess oil to be discharged into a tank is converted into heat without effectively acting to the steering circuit.

SUMMARY OF THE INVENTION

An object of this invention is to obviate defects encountered in prior art and to provide an improved hydraulic apparatus used for a vehicle such as a loader in which when fluid amount in a steering cylinder of a steering circuit is in short supply, the shortage is supplemented with oil from a change-over pump and in the other times the connection of the steering circuit with the change-over pump is cut off and only the oil from the steering pump is fed to the steering circuit.

According to this invention, there is provided a hydraulic apparatus used for a vehicle having a propulsion engine of the type comprising: a control valve; a flow dividing valve operatively connected to the control valve; at least two pumps driven by the engine for delivering fluid to the control and flow dividing valves; a steering circuit operatively connected to the control valve; and an implement circuit operatively connected to the flow dividing valve, the control valve comprising a valve body provided with a fluid inlet connected to a first pump of the pumps and including a plunger provided with orifices having degrees of openings variable in accordance with shift amount of the plunger and a spool operatively connected to the plunger through fluid passages and controlled by pressure difference caused between upstream and downstream portions of the orifices with respect to fluid flow direction from said first pump, and the hydraulic apparatus is characterized in that the flow dividing valve is provided with an oil inlet connected to a second pump of the pumps, a first oil outlet connected to the oil inlet of the control valve, and a second oil outlet connected to the implement circuit, and that the oil inlet of the flow dividing valve is cut off from the first oil outlet and connected to the second oil outlet when the pressure difference at the orifices is larger than a predetermined control pressure of the flow dividing valve, that the oil inlet of said flow dividing valve is connected to the first oil outlet when the pressure difference is lower than the predetermined control pressure of the flow dividing valve, and that the control pressure is predetermined to be lower than a control pressure of the spool of the control valve.

DESCRIPTION OF THE PREFERRED EMBODIMENTS

Figure 1:
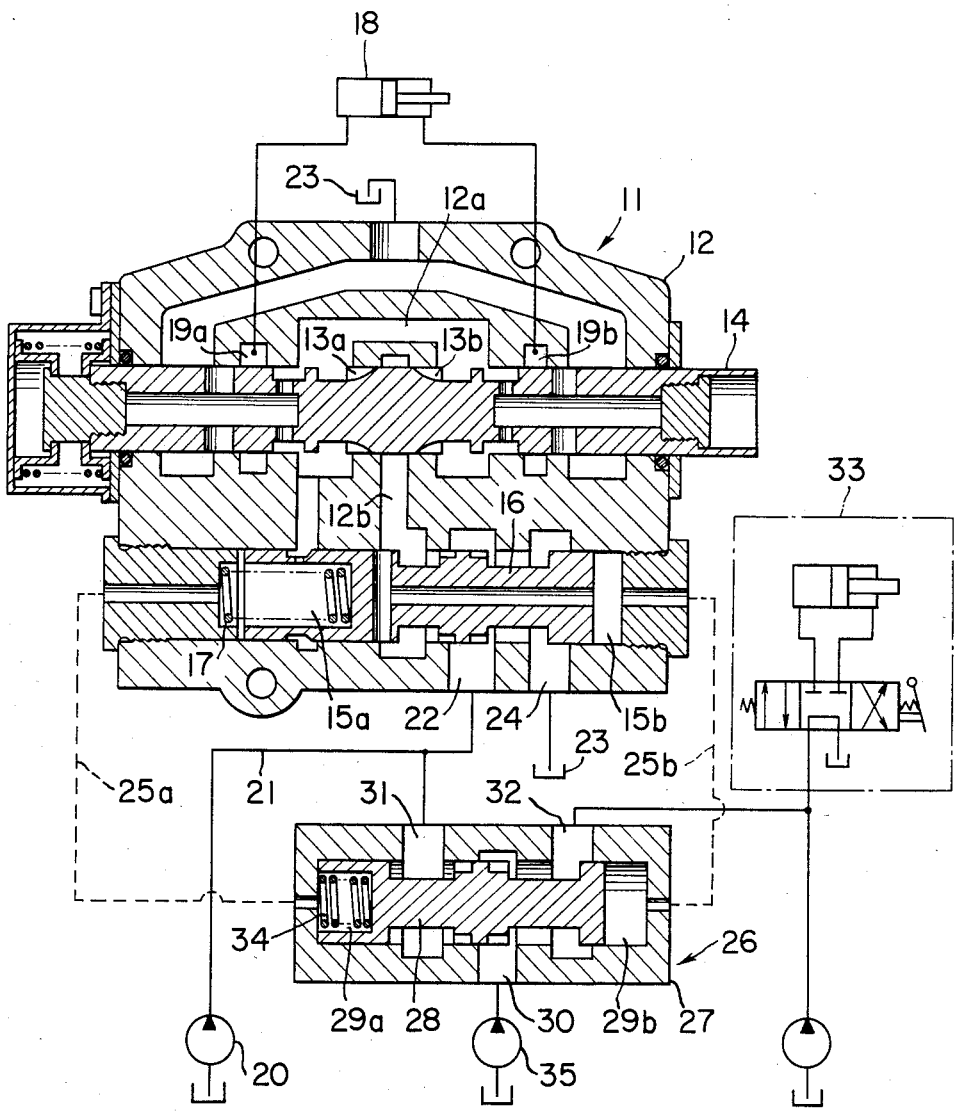
FIG. 1 shows a vertical cross section of one embodiment of a hydraulic apparatus for a vehicle according to this invention.

Referring to FIG. 1, a control valve 11 of a hydraulic apparatus shown comprises a valve body 12 into which are assembled a plunger 14 provided with orifices 13*a* and 13*b* having variable degrees of openings and a spool 16 operatively connected to the plunger 16 through passages. The spool 16 is provided with chambers 15*a* and 15*b* at both its end portions and operated by pressure difference between a passage 12*b* connecting the plunger 14 and the spool 16 and a chamber 12*a* provided for the valve body 12 in communication with the orifices 13*a* and 13*b* (hereinbelow, called difference pressure P). A spring 17 is assembled in the chamber 15*a* of the spool 16.

The valve body 12 is also provided with cylinder ports 19*a* and 19*b* operatively connected to a steering cylinder 18, an oil inlet 22 connected to a pump 20 through a conduit 21, and a by-pass port 24 communicated with a tank 23. The chambers 15*a* and 15*b* of the spool 16 are communicated with chambers 29*a* and 29*b* defined between a valve housing 27 of a flow dividing valve 26 and the end portions of a spool 28 assembled in the valve housing 27 through conduits 25*a* and 25*b*, respectively. The spool 28 is operated or controlled by the pressure difference P caused at the chamber 12*a* and the passage 12*b* and control pressure in the flow dividing valve 26 is predetermined to be smaller than that in the control valve 11. The valve housing 27 of the flow dividing valve 26 is provided with an oil inlet 30 communicated with a change-over pump 35, a first oil outlet 31 communicated with the oil inlet 30 and the conduit 21, and a second oil outlet 32 connected to an implement circuit 33, which is generally known per se for carrying out loading operations and usually comprises an actuator, a change-over valve means, and a hydraulic pump.

Thus, with the construction of the flow dividing valve 26, when the spool 28 is shifted rightwardly or leftwardly, the oil inlet 30 is communicated with the outlet 31 or 32, and the other construction of the valve 26 is known in the art, so that the details thereof are not now disclosed.

The hydraulic apparatus according to this invention operates as follows.

When the plunger 14 of the control valve 11 is positioned as shown in FIG. 1, where the oil from the pump 20 flows into the control valve 11, the variable orifices are closed and the chambers 15*a* and 15*b* of the spool 16 are communicated with the tank 23 and the oil inlet 22, respectively. When a pressure at the oil inlet 22 reaches a predetermined pressure, the spring 17 is compressed and the spool 16 is moved leftwardly as viewed in FIG. 1 and the oil fed in the oil inlet 22 is discharged into the tank 23 under unloaded condition. The predetermined pressure will be determined by dividing the urging force of the spring 17 by the area of the end surface of the spool 16 on which pressure is applied, and hereunder, this predetermined pressure is called the first control pressure.

Assuming that the plunger 14 is shifted rightwardly or leftwardly from the position now shown in FIG. 1, the variable orifice 13*a* or 13*b* opens by the degree of opening in response to the shift amount of the plunger 14, the connection between the chamber 12*a* and the tank 23 is cut off, and the orifice 13*a* or 13*b* is then communicated with the cylinder port 19*a* or 19*b*, whereby the oil having volume in accordance with the degree of opening of the orifice 13*a* or 13*b* flows towards the cylinder port 19*a* or 19*b* through the corresponding orifice. The spool 16 is at this time balanced at a portion where the pressure difference P becomes equal to the first control pressure described hereinbefore, so that even if a load pressure generated by the load on the steering cylinder 18 varies, only the predetermined amount of oil determined by the opening degree of the orifice 13*a* or 13*b* and the first control pressure is fed into the steering cylinder 18 and the residual amount of oil is returned to the tank 23.

When the load pressure on the steering cylinder 18 increases and the predetermined amount of oil does not flow through the orifice 13*a* or 13*b*, since a predetermined pressure difference is not caused, the spool 16 is rightwardly shifted by the urging force of the spring 17 and the communication between the oil inlet 22 and the by-pass port 24 is cut off.

On the other hand, when the load pressure on the steering cylinder 18 decreases and the predetermined amount of oil flows through the orifice 13*a* or 13*b*, a pressure difference more than the predetermined one is caused, so that the spool 16 is leftwardly shifted against the spring force and the communication between the oil inlet 22 and the by-pass port 24 is established.

Consequently, regardless of the load pressure on the steering cylinder 18, a predetermined amount of oil determined by the degree of opening of the variable orifice 13*a* or 13*b* and the first control pressure can be supplied to the steering cylinder 18 through the cylinder port 19*a* or 19*b*.

As described hereinbefore, when the pressure difference P between the chamber 12*a* and the passage 12*b* is maintained to be equal to the first control pressure, a pressure corresponding to that in the passage 12*b* of the valve body 12 applies to the chamber 29*b* through the chamber 15*b* and the conduit 25*b*, and on the other hand, a pressure corresponding to that in the chamber 12*a* applies to the chamber 29*a* through the chamber 15*a* and the conduit 25*a*. Accordingly, the pressure difference between the chambers 29*a* and 29*b* becomes equal to the first control pressure. Now assuming that a pressure acting for shifting the spool 28 against the urging force of the spring 34 is to be called a second control pressure, the spool 28 is leftwardly shifted and positioned as shown in FIG. 1 against the urging force of the spring 34 by preliminarily setting the second control pressure to be lower than the first control pressure. The communication between the oil inlet 30 and the oil outlet 31 is then cut off and the oil inlet 30 is communicated with the oil outlet 32. Accordingly, all amount of the oil from the pump 35 is not fed into the steering cylinder 18 but into the implement circuit 33, whereby the potential energy of the oil from the pump 35 can be effectively utilized for the implement circuit 33. The second control pressure is equal to a pressure obtained by dividing the urging force of the spring 34 by the area of the end surface of the spool 28 on which the oil pressure is applied.

In a case where the degree of opening of the orifice 13*a* or 13*b* increases and the pressure difference P becomes lower than the first control pressure, the spool 16 is rightwardly moved to thereby cut off the communication between the oil inlet 22 and the by-pass 24 and all amount of oil from the pump 20 is delivered into the steering cylinder 18 through the orifice 13*a* or 13*b*. When the opening degree of the orifice further increases and the pressure difference P lowers and becomes equal to the second control pressure, the spool 28 of the flow dividing valve 26 is shifted rightwardly from a position now illustrated in FIG. 1 by the force of the spring 34 to thereby operatively connect the oil inlet 30 to the oil outlet 31 and a part of oil from the pump 35 can be supplied to the oil inlet 22 of the control valve 11.

The spool 28 is then balanced at a position where the pressure difference P becomes equal to the second control pressure, so that even if the load pressure on the steering cylinder 18 varies, a predetermined amount of oil determined by the opening degree of the orifice 13*a* or 13*b* and the second control pressure is delivered into the steering cylinder 18 through the cylinder port 19*a* or 19*b*. The residual amount of oil from the pump 35 after a part of the oil has been fed into the control valve 11 is delivered into the implement circuit 33 through the oil outlet 32 of the flow dividing valve to thereby effectively utilize the oil from the pumps 20 and 35 for the operation of the hydraulic apparatus.

Figure 2:
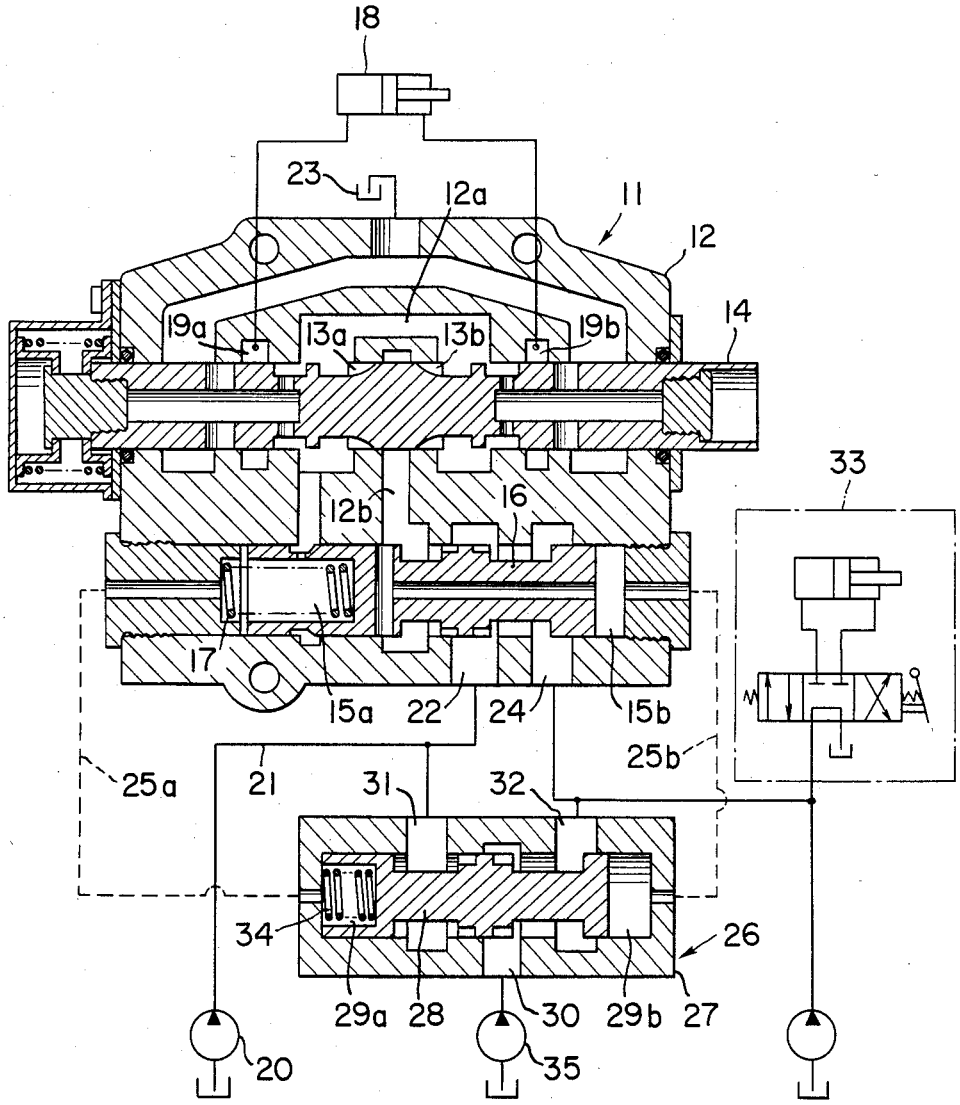
FIG. 2 shows a vertical cross section of another embodiment of a hydraulic apparatus for a vehicle according to this invention.

FIG. 2 shows another embodiment of this invention, in which the by-pass port 24 of the control valve 11 is connected to the oil outlet 32 of the flow dividing valve 26 in place of being connected to the tank 23 as shown in FIG. 1, and according to this embodiment, the oil flow from the by-pass port 24 directs towards the implement circuit 33.

With the embodiment shown in FIGS. 1 and 2, although the chambers 15*a* and 15*b* of the spool 16 in the control valve 11 are communicated respectively with the chambers 29*a* and 29*b* defined by the spool 28 and the valve housing 27 of the flow dividing valve 26 through the conduits 25*a* and 25*b*, the upstream and downstream portions of the orifices 13*a* and 13*b* may be operatively connected to the chambers 29*a* and 29*b* of the flow dividing valve 26 through conduits.

As described hereinabove, according to this invention, chambers formed in a spool of a control valve are respectively connected through conduits to chambers of a flow dividing valve to thereby control the flow dividing valve in accordance with pressure difference between upstream and downstream portion of orifices of a plunger assembled in the valve body of the control valve and to pertinently divide oil flow from a pump into steering and implement circuits, whereby the flow amount of oil necessary for the operation of the steering circuit can always be obtained in spite of a relatively simple construction of a hydraulic apparatus and the oil from the pump can be effectively utilized with considerably reduced energy loss.

We claim:

1. A hydraulic apparatus used for a vehicle having a propulsion engine of the type comprising a control valve having a valve body provided with a fluid inlet and containing a plunger, said plunger being provided with a pair of orifices only of which opens on one side exclusively at a time or vice versa in accordance with a shifting direction of said plunger and the degrees of said opening being variable in accordance with a shift amount of said plunger, valve means provided with a pressure compensation spool biased by a spring and operatively connected to said control valve to maintain a constant pressure drop across said variable orifices, at least two pumps driven by said engine for delivering fluid, a steering circuit operatively connected to said control valve, and an implement circuit operatively connected to said first spool to receive returned excess oil therefrom, said fluid inlet of said control valve being connected to a first pump of said pumps, said first spool being provided with an oil inlet connected to a second pump of said pumps and first and second oil outlets connected respectively to said fluid inlet of said control valve and to said implement circuit, and control valve further comprising a second pressure compensating spool biasing by a spring and operatively connected to said plunger through fluid passages to maintain a constant pressure drop across said variable orifices and to return excess oil to an external tank, said second spool being controlled by a pressure difference caused between upstream and downstream portions of said orifices with respect to fluid flow direction from said first pump, said oil inlet of said first spool being cut off from said first oil outlet and connected to said second oil outlet when said pressure difference at said orifices is larger than a pre-determined control pressure of said first spool, said oil inlet of said first spool being connected to said first oil outlet when said pressure difference is lower than said predetermined control pressure of said first spool, and said control pressure being determined to be lower than a pressure predetermined to control said second spool.

* * * * *